US010311888B2

(12) United States Patent
Nakashika et al.

(10) Patent No.: US 10,311,888 B2
(45) Date of Patent: Jun. 4, 2019

(54) VOICE QUALITY CONVERSION DEVICE, VOICE QUALITY CONVERSION METHOD AND PROGRAM

(71) Applicant: THE UNIVERSITY OF ELECTRO-COMMUNICATIONS, Chofu-shi, Tokyo (JP)

(72) Inventors: Toru Nakashika, Tokyo (JP); Yasuhiro Minami, Tokyo (JP)

(73) Assignee: THE UNIVERSITY OF ELECTRO-COMMUNICATIONS, Tokyo (JP)

( * ) Notice: Subject to any disclaimer, the term of this patent is extended or adjusted under 35 U.S.C. 154(b) by 0 days.

(21) Appl. No.: 16/079,383

(22) PCT Filed: Feb. 22, 2017

(86) PCT No.: PCT/JP2017/006478
§ 371 (c)(1),
(2) Date: Aug. 23, 2018

(87) PCT Pub. No.: WO2017/146073
PCT Pub. Date: Aug. 31, 2017

(65) Prior Publication Data

US 2019/0051314 A1 Feb. 14, 2019

(30) Foreign Application Priority Data

Feb. 23, 2016 (JP) ..... 2016-032488

(51) Int. Cl.
*G10L 21/00* (2013.01)
*G10L 21/013* (2013.01)
(Continued)

(52) U.S. Cl.
CPC ..... *G10L 21/013* (2013.01); *G10L 21/007* (2013.01); *G10L 2021/0135* (2013.01)

(58) Field of Classification Search
CPC ..... G10L 15/01; G10L 15/06; G10L 21/013; G10L 2021/0135
(Continued)

(56) References Cited

U.S. PATENT DOCUMENTS

2015/0058015 A1 2/2015 Mitsufuji et al.

FOREIGN PATENT DOCUMENTS

JP 2008-058696 A 3/2008
JP 2010-014913 A 1/2010
JP 2015-040903 A 3/2015

OTHER PUBLICATIONS

May 16, 2017 International Search Report issued in International Patent Application No. PCT/JP2017/006478.
(Continued)

*Primary Examiner* — Thierry L Pham
(74) *Attorney, Agent, or Firm* — Oliff PLC

(57) ABSTRACT

A voice conversion device includes: a parameter learning unit in which a probabilistic model that uses speech information, speaker information, and phonological information as variables to thereby express relationships among binding energies between any two of the speech information, the speaker information and the phonological information by parameters is prepared, wherein the speech information is obtained based on a speech, the speaker information corresponds to the speech information, and the phonological information expresses the phoneme of the speech, and in which the parameters are determined by performing learning by sequentially inputting the speech information and the speaker information into the probabilistic model; and a voice conversion processing unit that performs voice conversion processing of the speech information obtained on the basis of the speech of an input speaker, based both on the
(Continued)

parameters determined by the parameter learning unit and on the speaker information of a target speaker.

4 Claims, 7 Drawing Sheets

(51) Int. Cl.
*G10L 21/007* (2013.01)
*G10L 25/00* (2013.01)

(58) Field of Classification Search
USPC ..... 704/203, 240, 269, 278
See application file for complete search history.

(56) References Cited

OTHER PUBLICATIONS

T. Nakashika et al.; "Parallel-Data-Free, Many-To-Many Voice Conversion Using an Adaptive Restricted Boltzmann Machine"; Proceedings of Machine Learning in Spoken Language Processing (MLSLP) 2015, pp. 1-6, 2015.

T. Nakashika et al.; "Simultaneous Modelling of Acoustic, Phonetic, Speaker Features Using Improved Three-Way Restricted Boltzmann Machine"; Information Processing Society of Japan Kenkyu Hokoku Onsei Gengo Joho Shori (SLP); Dec. 3, 2015; 2015-SLP-109, SP2015-71, pp. 1-6.

VOICE QUALITY CONVERSION DEVICE, VOICE QUALITY CONVERSION METHOD AND PROGRAM

TECHNICAL FIELD

The present invention relates to a voice conversion device, a voice conversion method and a program that make it possible to perform voice conversion for an arbitrary speaker.

BACKGROUND ART

Conventionally, in the field of voice conversion (a technique in which only information about the individuality of an input speaker is converted into that of an output speaker, while phonological information of a speech of the input speaker is held), a parallel voice conversion is a mainstream technique in which parallel data (a speech pair based on the same utterance content uttered both by an input speaker and by an output speaker) is used when performing model learning.

As the parallel voice conversion, various statistical approaches are proposed, such as a method based on GMM (Gaussian Mixture Model), a method based on NMF (Non-negative Matrix Factorization), a method based on DNN (Deep Neural Network) and the like (see PTL 1). In the parallel voice conversion, although higher accuracy can be achieved due to the parallel constraint, it is necessary to bring the utterance content of the input speaker in line with the utterance content of output speaker, in the learning data, and which impairs the convenience.

In contrast, a non-parallel voice conversion (a technique in which the parallel data is not used when performing model learning) is attracting increasing attention. Although inferior to the parallel voice conversion in accuracy, the non-parallel voice conversion can perform learning using free utterance, and therefore is superior in terms of convenience and usefulness. NPL 1 discloses a technique in which a plurality of parameters are previously learned using a speech of an input speaker and a speech of an output speaker, and thereby convert the voice of the input speaker into the voice of the output speaker, wherein either one of the input speaker and the output speaker in contained in the learning data.

CITATION LIST

Patent Literature

PTL 1: Japanese Unexamined Patent Application Publication No. 2008-58696

Non Patent Literature

NPL 1: T. Nakashika, T. Takiguchi, and Y. Ariki: "Parallel-Data-Free, Many-To-Many Voice Conversion Using an Adaptive Restricted Boltzmann Machine," Proceedings of Machine Learning in Spoken Language Processing (MLSLP) 2015, 6 pages, 2015.

SUMMARY OF INVENTION

Technical Problem

In NPL 1, the non-parallel voice conversion is used. Compared to the parallel voice conversion which needs parallel data, the non-parallel voice conversion does not need parallel data and therefore is superior in terms of convenience and usefulness. However, a problem with the non-parallel voice conversion is that it is necessary to previously learn a speech of the input speaker. Further, another problem with the non-parallel voice conversion is that it is necessary to specify an input speaker in advance when performing voice conversion, so that it is not possible to satisfy a need of outputting the voice of a specific speaker regardless of the input speaker.

The present invention is made in view of the aforesaid problems, and an object of the present invention make possible to perform voice conversion to convert the voice of an input speaker to the voice of a target speaker, even if the input speaker is not specified in advance.

Solution to Problem

To solve the aforesaid problems, a voice conversion device according to an aspect of the present invention is adapted to perform voice conversion to convert the voice of an input speaker into the voice of a target speaker. The voice conversion device includes a parameter learning unit and a voice conversion processing unit.

In the parameter learning unit, a probabilistic model that uses speech information, speaker information, and phonological information as variables to thereby express relationships among binding energies between any two of the speech information, the speaker information and the phonological information by parameters is prepared, wherein the speech information is obtained based on a speech, the speaker information corresponds to the speech information, and the phonological information expresses the phoneme of the speech. Further, in the parameter learning unit, the parameters are determined by performing learning by sequentially inputting the speech information and the speaker information corresponding to the speech information into the probabilistic model.

The voice conversion processing unit performs voice conversion processing of the speech information obtained on the basis of the speech of the input speaker, based both on the parameters determined by the parameter learning unit and on the speaker information of the target speaker.

Advantageous Effects of Invention

According to the present invention, since the phoneme can be estimated from the speech only while considering the speaker, it becomes possible to perform a voice conversion to convert the voice of an input speaker to the voice of a target speaker even if the input speaker is not specified.

DESCRIPTION OF EMBODIMENTS

Preferred embodiments of the present invention are described below.

<Configuration>

Figure 1:
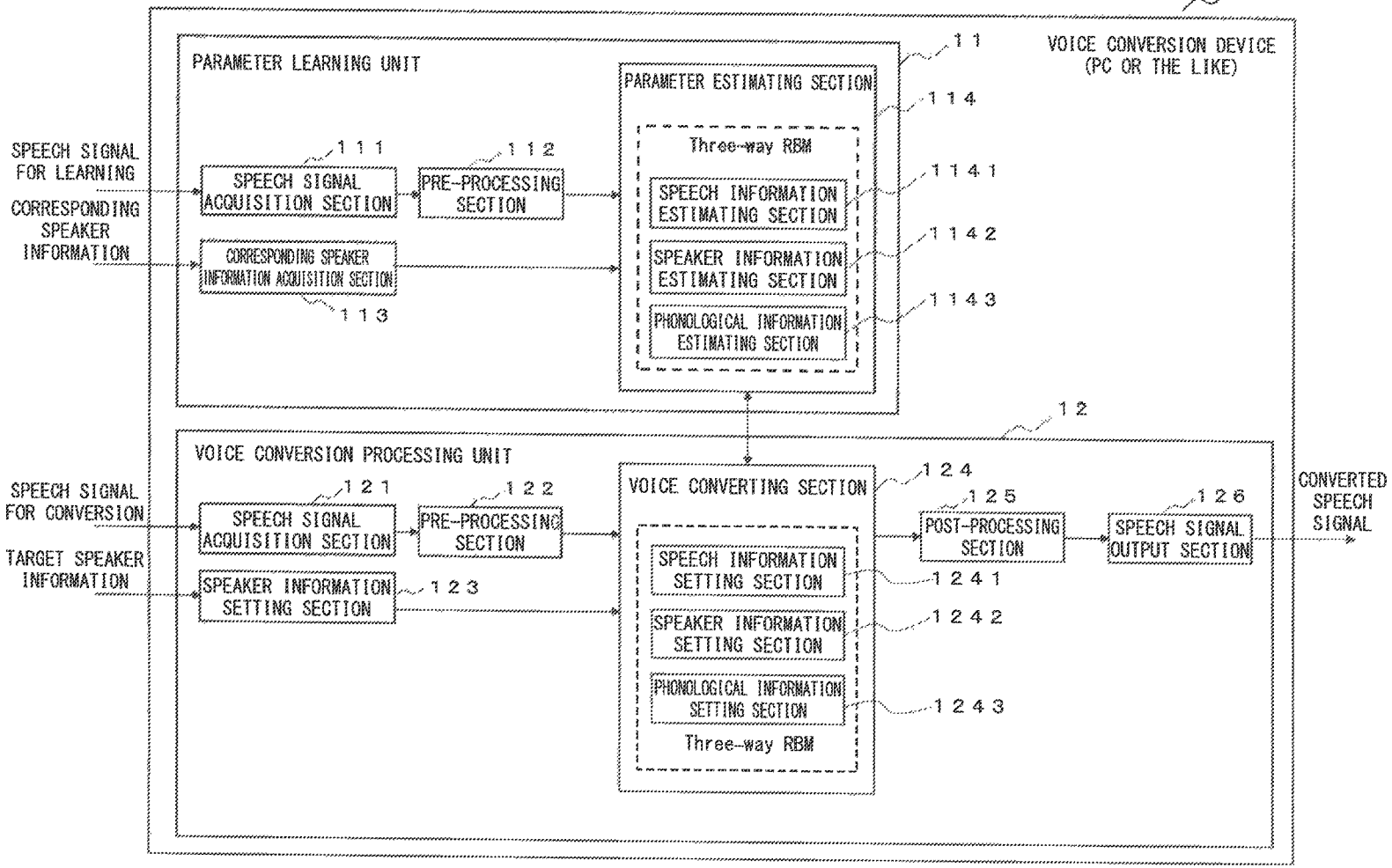
FIG. 1 is a block diagram showing an example configuration of a voice conversion device according to an embodiment of the present invention.

FIG. 1 is a block diagram showing an example configuration of a voice conversion device 1 according to an embodiment of the present invention. The voice conversion device 1 shown in FIG. 1, which is configured by a PC or the like, previously performs learning based on a speech signal for learning and information about a speaker corresponding to the speech signal for learning (referred to as "corresponding speaker information" hereinafter) to thereby convert a speech signal for conversion caused by an arbitrary speaker into a voice of a target speaker, and outputs the voice of the target speaker as a converted speech signal.

The speech signal for learning may either be a speech signal based on speech data recorded in advance, or a speech signal obtained by directly converting a speech (sound wave) vocalized by a speaker through a microphone or the like into an electrical signal. The corresponding speaker information is not particularly limited as long as it can discriminate whether one speech signal for learning and another speech signal for learning are speech signals caused by the same speaker or by different speakers.

The voice conversion device 1 includes a parameter learning unit 11 and a voice conversion processing unit 12. The parameter learning unit 11 is adapted to determine parameters for voice conversion by performing learning based on the speech signal for learning and the corresponding speaker information. After the parameters are determined by performing the aforesaid learning, the voice conversion processing unit 12 converts the voice of the speech signal for conversion into the voice of the target speaker based on the determined parameters and the information of the target speaker (referred to as "target speaker information" hereinafter), and outputs the voice of the target speaker as the converted speech signal.

The parameter learning unit 11 includes a speech signal acquisition section 111, a pre-processing section 112, a corresponding speaker information acquisition section 113, and a parameter estimating section 114. The speech signal acquisition section 111 is connected to the pre-processing section 112, and the pre-processing section 112 and the corresponding speaker information acquisition section 113 are respectively connected to the parameter estimating section 114.

The speech signal acquisition section 111 is adapted to acquire the speech signal for learning from an external device connected thereto. For example, the speech signal for learning is acquired based on operation performed by a user from an input section (not shown) such as a mouse, a keyboard or the like. Alternatively, the speech signal acquisition section 111 may also be connected to a microphone, so that the utterance of the speaker is captured in real time.

The pre-processing section 112 is adapted to partition the speech signal for learning acquired by the speech signal acquisition section 111 into time segments (where each time segment is referred to as a "frame" hereinafter), calculate spectral features of the speech signal for each frame, and then perform normalization processing to thereby generate speech information for learning, wherein examples of the spectral features include MFCC (Mel-Frequency Cepstrum Coefficients), Mel-cepstrum features and the like.

The corresponding speaker information acquisition section 113 is adapted to acquire the corresponding speaker information associated with the acquisition of the speech signal for learning by the speech signal acquisition section 111. The corresponding speaker information is not particularly limited as long as it can discriminate the speaker of one speech signal for learning from the speaker of another speech signal for learning. The corresponding speaker information may be acquired by, for example, performing input operation by the user from an input section (not shown). Alternatively, if it is clear that a plurality of speech signals for learning respectively correspond to different speakers, when acquiring a speech signal for learning, the corresponding speaker information acquisition section may automatically impart corresponding speaker information to the acquired speech signal for learning. For example, assuming that the parameter learning unit 11 learns speaking voices of 10 speakers, the corresponding speaker information acquisition section 113 acquires information for distinguishing the speaker, among the 10 speakers, whose speech signal for learning is being inputted into the speech signal acquisition section 111 (i.e., the corresponding speaker information), wherein the corresponding speaker information acquisition section 113 acquires the corresponding speaker information automatically or by an input operation performed by the user. Incidentally, herein the number of the speakers whose speaking voices are learned is not limited to be 10, but may also be other number than 10.

The parameter estimating section 114 includes a probabilistic model 3-way RBM, which is configured by a speech information estimating section 1141, a speaker information estimating section 1142 and a phonological information estimating section 1143.

The speech information estimating section 1141 is adapted to acquire speech information using phonological information, speaker information and various parameters. The speech information is an acoustic vector (such as spectral features, cepstrum features and the like) of the speech signals of the respective speakers.

The speaker information estimating section 1142 is adapted to acquire the speaker information using the speech information, the phonological information and the various parameters. The speaker information is information for specifying a speaker, and is information about a speaker vector owned by the sound of the respective speakers. The speaker information (the speaker vector) is a vector adapted to specify the speaker of the speech signal, so that it is common for all speech signals of the same speaker and different for speech signals of different speakers.

The phonological information estimating section 1143 is adapted to estimate the phonological information based on the speech information, the speaker information and the various parameters. The phonological information is information common for all speakers on which learning is to be performed, and is obtained from the information contained in the speech information. For example, if the inputted speech signal for learning is a signal of a speech uttering "kon nichiwa" (note: "kon nichiwa" is a Japanese phrase for "Hello"), then the phonological information obtained from the speech signal will be information corresponding to the phrase uttering "kon nichiwa". Although the phonological information in the present embodiment is information corresponding to phrase, it is not information about so-called text, but is information about phoneme not limited to the kind of language. To be specific, the phonological information in the present embodiment is a vector which expresses information other than the speaker information, is common for all cases no matter what language the speaker is speaking, and is potentially contained in the speech signal.

The probabilistic model 3-way RBM of the parameter estimating section 114 has the three pieces of information (i.e., the speech information, the speaker information, and the phonological information) respectively estimated by the three estimating sections 1141, 1142, 1143. However, the probabilistic model 3-way RBM not only has the speech information, the speaker information and the phonological information, but also expresses relationships among binding energies between any two of the three pieces of information by parameters.

Details about the speech information estimating section 1141, the speaker information estimating section 1142, the phonological information estimating section 1143, the speech information, the speaker information, the phonological information, various parameters, and the probabilistic model 3-way RBM will be described later.

The voice conversion processing unit 12 includes a speech signal acquisition section 121, a pre-processing section 122, a speaker information setting section 123, a voice converting section 124, a post-processing section 125, and a speech signal output section 126. The speech signal acquisition section 121, the pre-processing section 122, the voice converting section 124, the post-processing section 125, and the speech signal output section 126 are connected in this order. The voice converting section 124 is further connected to the parameter estimating section 114 of the parameter learning unit 11.

The speech signal acquisition section 121 acquires the speech signal for conversion, and the pre-processing section 122 generates speech information for conversion based on the speech signal for conversion. In the present embodiment, the speech signal for conversion acquired by the speech signal acquisition section 121 may be a speech signal for conversion caused by an arbitrary speaker. In other words, the speaking voice of a speaker having not been learned in advance is supplied to the speech signal acquisition section 121.

The speech signal acquisition section 121 and the pre-processing section 122 respectively have the same configurations as those of the speech signal acquisition section 111 and the pre-processing section 112 of the parameter learning unit 11, which has been described above. Thus, alternatively, the speech signal acquisition section 121 and the pre-processing section 122 may be omitted, and in such a case the speech signal acquisition section 111 and the pre-processing section 112 also serve the functions of the speech signal acquisition section 121 and the pre-processing section 122 respectively.

The speaker information setting section 123 is adapted to set a target speaker (which is a voice conversion destination), and output target speaker information. Here, the target speaker to be set by the speaker information setting section 123 is selected from speakers whose speaker information is acquired by the parameter estimating section 114 of the parameter learning unit 11 by performing learning processing in advance. For example, the speaker information setting section 123 may select the target speaker by performing an operation in which a user operates an input section (not shown) to select a target speaker from a list of options composed of a plurality of target speakers (for example, a list of speakers on which learning processing has been performed in advance by the parameter estimating section 114) displayed on a display or the like (not shown). Alternatively, when performing such operation, the speech of the target speaker may be confirmed through an audio speaker (not shown).

The voice converting section 124 is adapted to perform voice conversion on the speech information for conversion based on the target speaker information, and output converted speech information. The voice converting section 124 has a speech information setting section 1241, a speaker information setting section 1242, and a phonological information setting section 1243. The speech information setting section 1241, speaker information setting section 1242 and phonological information setting section 1243 have the same functions as the speech information estimating section 1141, speaker information estimating section 1142 and phonological information estimating section 1143 owned by the probabilistic model 3-way RBM in the parameter estimating section 114. In other words, the speech information setting section 1241, speaker information setting section 1242 and phonological information setting section 1243 are set with the speech information, the speaker information and the phonological information respectively, wherein the phonological information set in the phonological information setting section 1243 is information obtained based on the speech information supplied from the pre-processing section 122. On the other hand, the speaker information set in the speaker information setting section 1242 is the speaker information (the speaker vector) about the target speaker acquired based on the estimated result obtained by the speaker information estimating section 1142 of the parameter learning unit 11. Further, the speech information set in the speech information setting section 1241 is obtained based on the speaker information set in the speaker information setting section 1242, the phonological information set in the phonological information setting section 1243, and various parameters.

Incidentally, FIG. 1 shows a configuration in which the voice converting section 124 is provided; however, the present invention also includes a configuration in which the voice converting section 124 is not provided separately, and the parameter estimating section 114 performs voice conversion processing by fixing the various parameters of the parameter estimating section 114.

The post-processing section 125 performs an inverse normalization processing and then an inverse FFT processing on the converted speech information obtained in the voice converting section 124 to thereby revert spectral information to the speech signal of each frame, and then combine the speech signal of each frame to generate a converted speech signal.

The speech signal output section 126 outputs the converted speech signal to an external device connected thereto. Examples of the external device connected to the speech signal output section 126 include an audio speaker.

Figure 2:
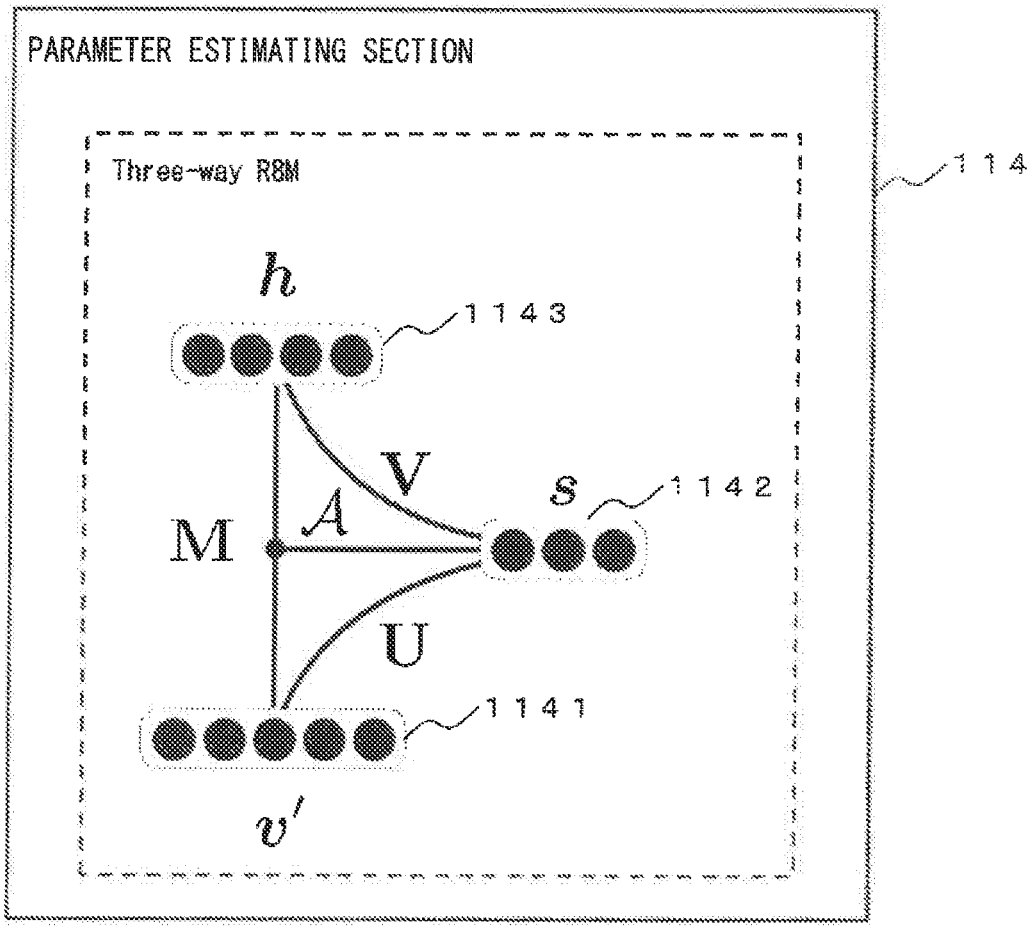
FIG. 2 is a view schematically showing a probabilistic model 3-way RBM (Restricted Boltzmann machine) of a parameter estimating section shown in FIG. 1.

FIG. 2 is a view schematically showing the probabilistic model 3-way RBM of the parameter estimating section. As described above, the probabilistic model 3-way RBM includes the speech information estimating section 1141, speaker information estimating section 1142 and the phonological information estimating section 1143, and these sections are expressed by Formula (1) of three variables joint probability density functions shown as below, in which speech information v, speaker information s and phonological information h are each a variable. Incidentally, the speaker information s and the phonological information h are each a binary vector, in which a state where every elements are ON (active) is expressed by 1.

[Mathematical Expression 1]

$$p(v, h, s) = \frac{1}{N} e^{-E(v,h,s)} \tag{1}$$
$$v = [v_1, \ldots, v_D] \in \mathbb{R}^D$$
$$s = [s_1, \ldots, s_R] \in \{0, 1\}^R, \sum_k s_k = 1$$
$$h = [h_1, \ldots, h_H] \in \{0, 1\}^H, \sum_j h_j = 1$$

In Formula (1), E represents an energy function for performing speech modeling, and N represents a normalization term. Here, as shown in Formulas (2) to (5) below, the energy function E is related by seven parameters ($\Theta=\{M, A, U, V, b, c, \sigma\}$), wherein M expresses the degree of the relationship between the speech information and the phonological information, V expresses the degree of the relationship between the phonological information and the speaker information, U expresses the degree of the relationship between the speaker information and the speech information, A represents a set of projection matrix which is adapted to linearly transform M and which is determined by the speaker information s, b represents a bias of the speech information, c represents a bias of the speech information, and $\sigma$ represents the deviation of the speech information.

[Mathematical Expression 2]

$$E(v, h, s) = \frac{1}{2} v^\top \bar{v} - b^\top \bar{v} - c^\top h - h^\top V s - s^\top U \bar{v} - \bar{v}^\top A_s M h, \tag{2}$$

In Formula (2), $A_s=\Sigma_k A_k s_k$, and $M=[m_1, \ldots, m_H]$; and for convenience, $A=\{A_k\}_k$. Further, $v^-$ represents a vector obtained by dividing v by parameter $\sigma^2$ for each element. Note that, the "$^-$" of the "$v^-$" in the specification of the present application is originally added over "v" as shown in Formula (2); however, due to restrictions in the description of the specification, the "$v^-$" is used instead. Also, the "$^\sim$" of the "$v^\sim$", "$s^\sim$" and "$h^\sim$" in the specification of the present application is originally added over "v" "s" and "h", and "$^\wedge$" of "$h^\wedge$" is originally added over "h"; however, the "$v^\sim$", "$s^\sim$", "$h^\sim$" and "$h^\wedge$" are used instead for the same reason.

At this time, conditional probabilities are respectively expressed as the following Formulas (3) to (5).

[Mathematical Expression 3]

$$p(v|h,s) = \mathcal{N}(v|b+U^T s+A_s M h, \sigma^2) \tag{3}$$

$$p(h|s,v) = \mathcal{B}(h|f(c+Vs+M^T A_s^T \bar{v})) \tag{4}$$

$$p(s|v,h) = \mathcal{B}(s|f(U\bar{v}+V^T h+[\bar{v}^T A_k]Mh)) \tag{5}$$

In Formulas (3) to (5), N represents a multivariate normal distribution with independent dimensions, B represents a multidimensional Bernoulli distribution, and f represents a softmax function for each element.

In the above Formulas (1) to (5), the various parameters are estimated so that log likelihood with respect to T frames of speech information of R speakers is maximized. The details of how to estimate the various parameters will be described later.

Figure 3:
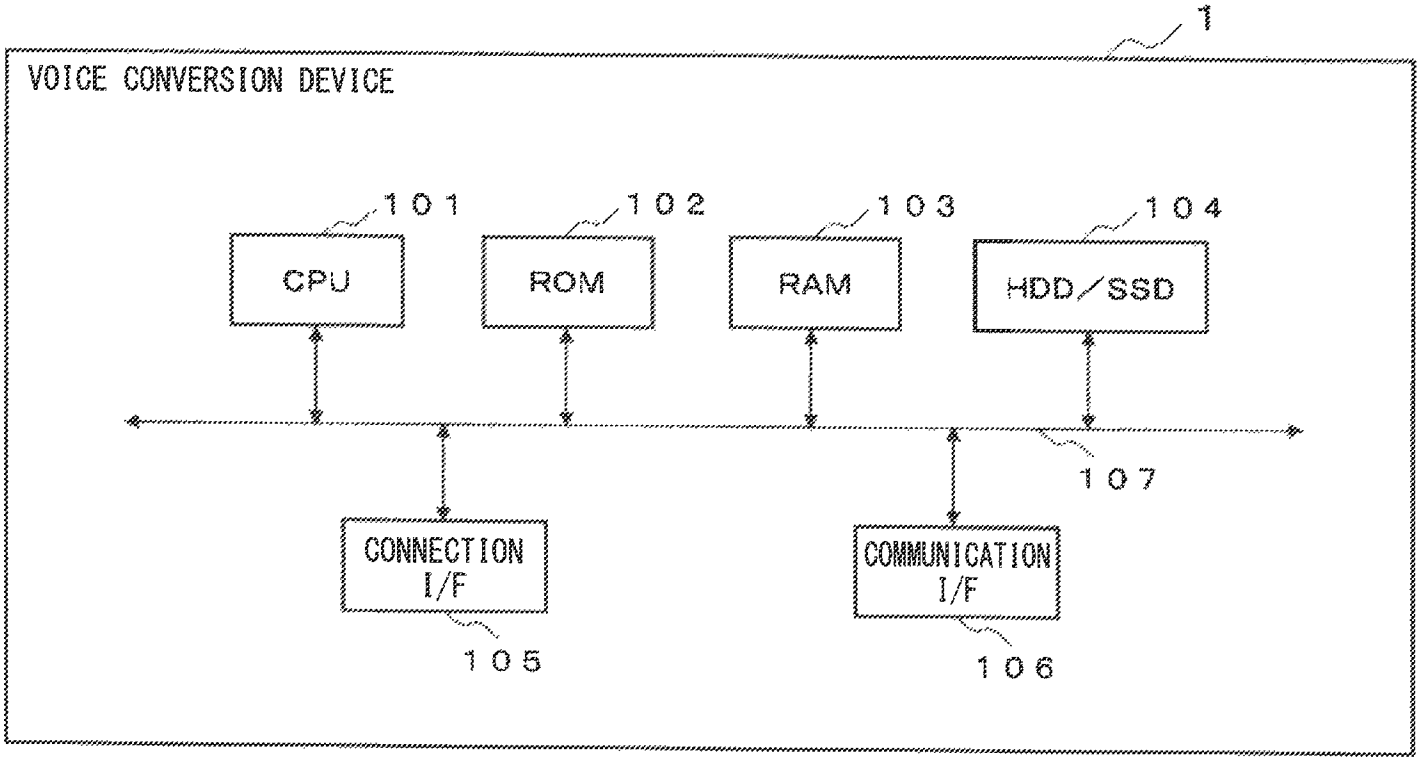
FIG. 3 is a diagram showing an example of a hardware configuration of the voice conversion device shown in FIG. 1.

FIG. 3 is a diagram showing an example configuration of the hardware of the voice conversion device 1. As shown in FIG. 3, the voice conversion device 1 includes a CPU (Central Processing Unit) 101, a ROM (Read Only Memory) 102, a RAM (Random Access Memory) 103, and a HDD (Hard Disk Drive)/SSD (Solid State Drive) 104, a connection I/F (interface) 105 and a communication I/F 106. All these components are connected with each other via a bus 107. The CPU 101 totally controls the operation of the voice conversion device 1 by executing a program stored in the ROM 102 or the HDD/SSD 104 with the RAM 103 as a work area. The connection I/F 105 functions as an interface between the voice conversion device 1 and a device connected to the voice conversion device 1. The communication I/F 106 functions as an interface for performing communication between the voice conversion device 1 and other information-processing devices through a network.

The input/output of the speech signal, the input of the speaker information and the setting of the speaker information are performed through the connection I/F 105 or the communication I/F 106. The functions of the voice conversion device 1 described with reference to FIG. 1 are achieved by executing a predetermined program in the CPU 101. The program may either be acquired through a record medium, or through the network. Alternatively, the program may be used in a state where the program is incorporated into the ROM. Further, a hardware configuration for achieving the configuration of the voice conversion device 1 by providing a logic circuit such as an ASIC (Application Specific Integrated Circuit), a FPGA (Field Programmable Gate Array) or the like may be alternatively employed, instead of using a combination of a general computer and a program.

<Operations>

Figure 4:
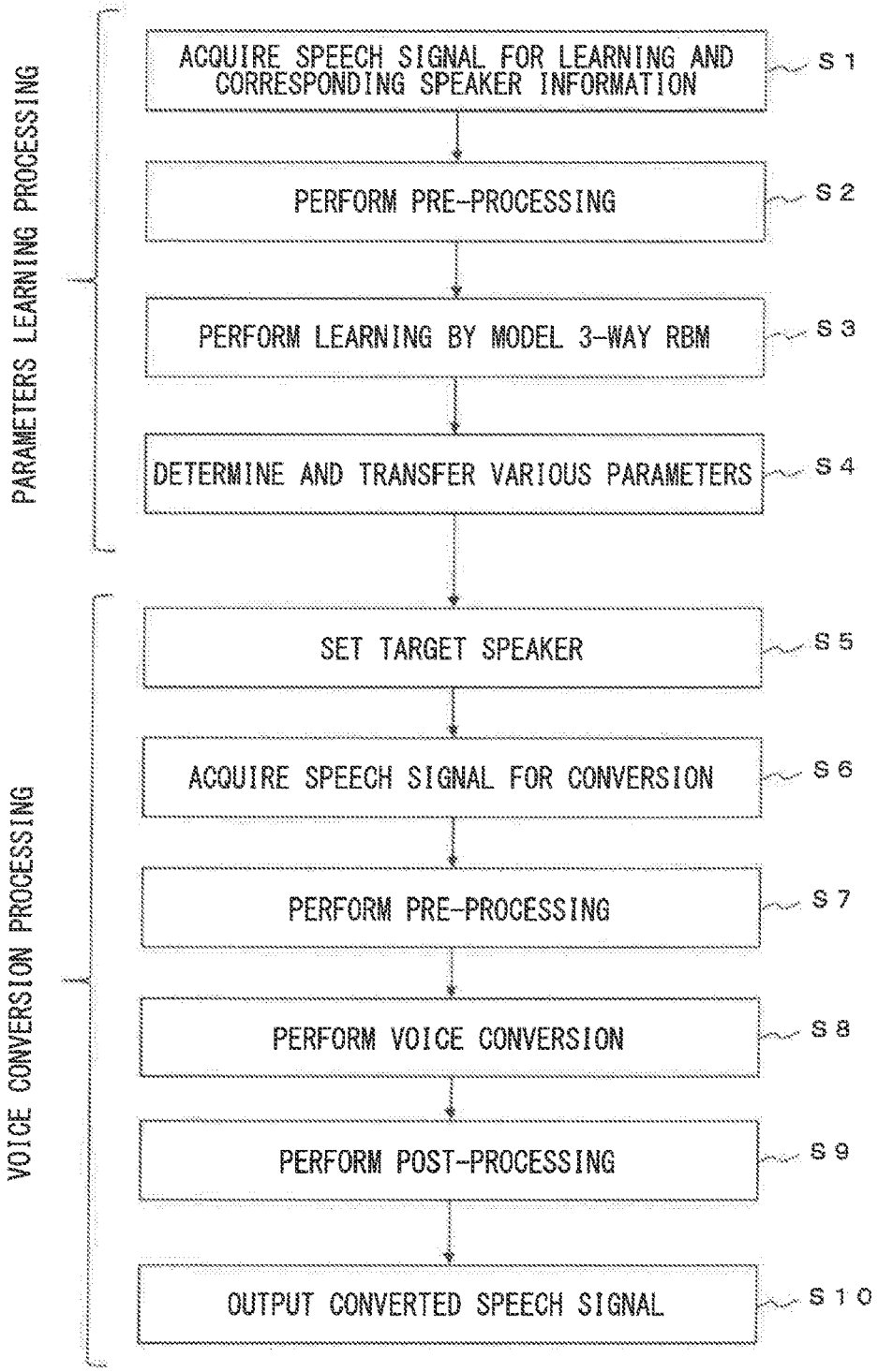
FIG. 4 is a flowchart showing a processing example of the aforesaid embodiment.

FIG. 4 is a flowchart showing a processing example of the aforesaid embodiment. As shown in FIG. 4, as parameters learning processing, the speech signal acquisition section 111 and the corresponding speaker information acquisition section 113 of the parameter learning unit 11 of the voice conversion device 1 respectively acquire the speech signal for learning and the corresponding speaker information based on the instruction of the user inputted through an input section (not shown) (Step S1).

The pre-processing section 112 generates the speech information for learning based on the speech signal for learning acquired by the speech signal acquisition section 111, wherein the speech information for learning is to be supplied to the parameter estimating section 114 (Step S2).

Figure 5:
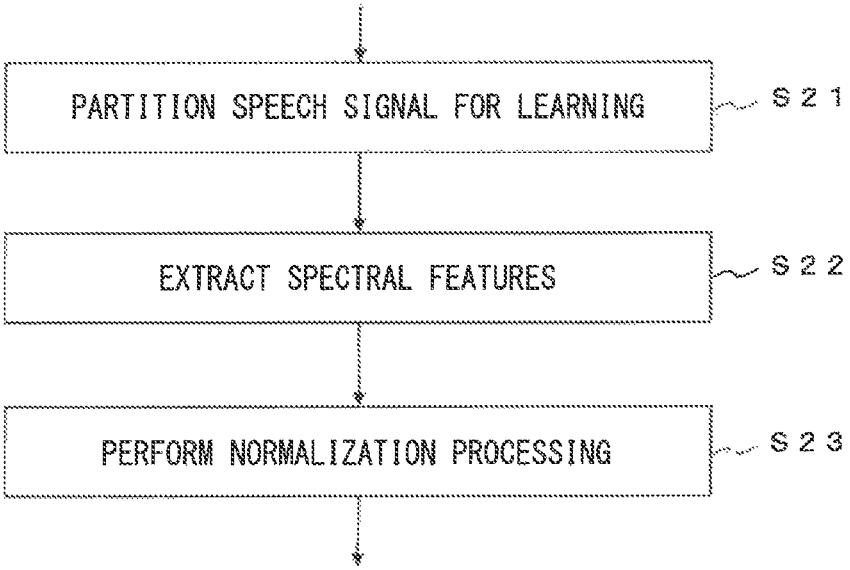
FIG. 5 is a flowchart showing a detailed example of the pre-processing shown in FIG. 4.

The details of Step S2 will be described below with reference to FIG. 5. As shown in FIG. 5, the pre-processing section 112 partitions the speech signal for learning into a plurality of frames (each frame is, for example, 5 msec) (Step S21), and FFT processing or the like is performed on the partitioned speech signal for learning to thereby calculate spectral features (such as MFCC, Mel-cepstrum features and the like) (Step S22). Further, the speech information for learning v is generated by performing normalization processing (such as normalization using average and variance of each dimension) on the spectral features obtained in Step S22 (Step S23).

The speech information for learning v, along with the corresponding speaker information s acquired by the corresponding speaker information acquisition section 113, is outputted to the parameter estimating section 114.

In the probabilistic model 3-way RBM, the parameter estimating section 114 performs learning for estimating the various parameters (M, V, U, A, b, c, σ) using the speech information for learning v and the corresponding speaker information s (Step S3).

To be specific, the parameter estimating section 114 estimates the various parameters M, V, U, A, b, c, σ so that log likelihood L expressed by the following Formula (6) with respect to T frames of speech data of R (R≥2) speakers (combination of the speech information for learning and the corresponding speaker information) $X=\{v_t,s_t\}^T_{t=1}$ is maximized. Here, t represents time t, and $v_t$, $s_t$, $h_t$ respectively represent the speech information, the speaker information and the phonological information at time t.

[Mathematical Expression 4]

$$\mathcal{L} = \log\ p(X) = \sum_t \log \sum_h p(v_t, h_t, s_t) \tag{6}$$

Figure 6:
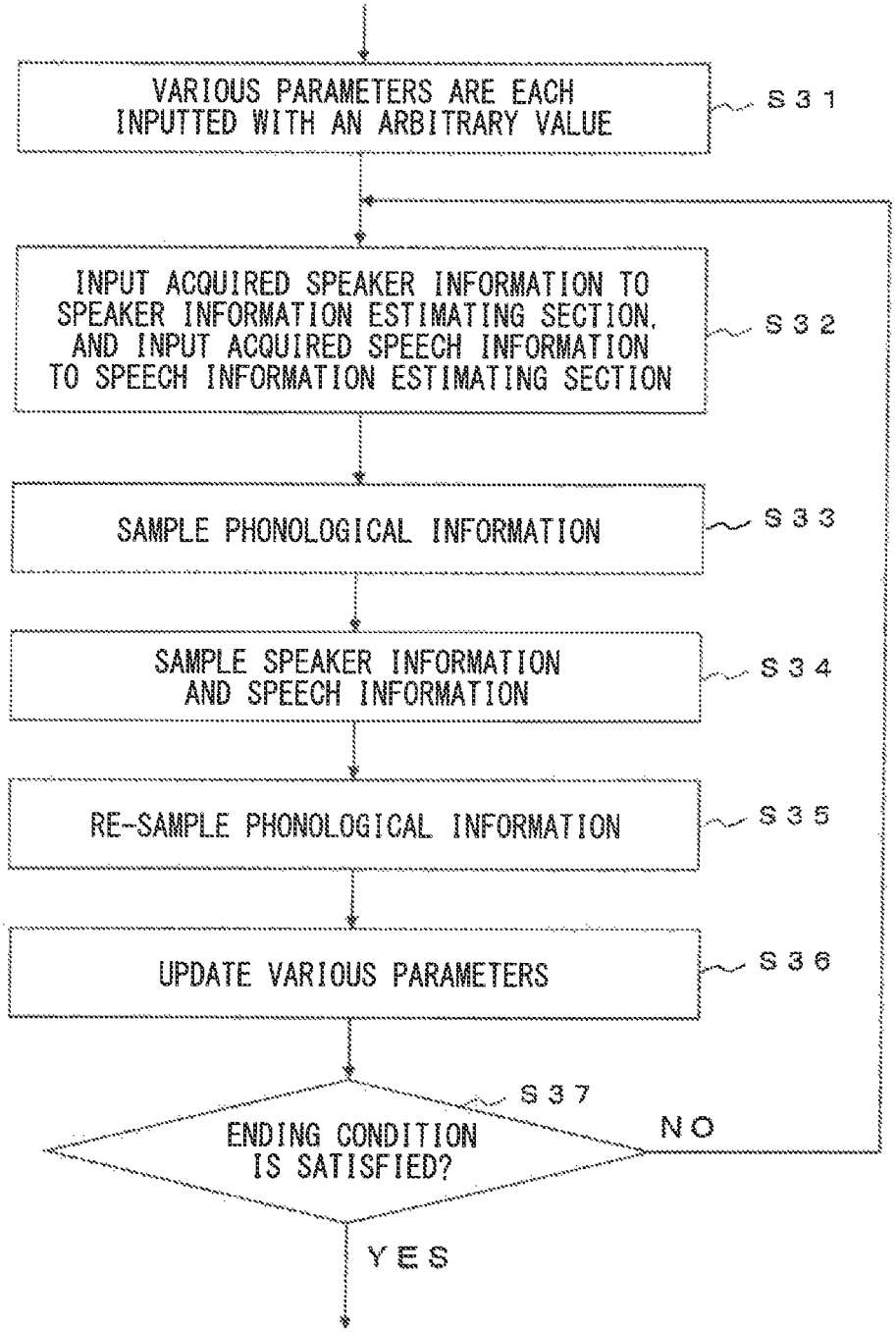
FIG. 6 is a flowchart showing a detailed example of the learning by the probabilistic model 3-way RBM shown in FIG. 4.

The details of Step S3 will be described below with reference to FIG. 6. First, as shown in FIG. 6, in the probabilistic model 3-way RBM, the various parameters M, V, U, A, b, c, σ are each inputted with an arbitrary value (Step S31); the speech information for learning v is inputted to the speech information estimating section 1141, and the corresponding speaker information s is inputted to the speaker information estimating section 1142 (Step S32).

Further, a conditional probability density function of the phonological information h is determined using the speech information for learning v and the corresponding speaker information s according to Formula (4) described above, and the phonological information h is sampled based on the probability density function thereof (Step S33). The term " . . . is sampled" here and hereinafter means randomly generating a piece of data in accordance with the conditional probability density function.

Next, a conditional probability density function of the corresponding speaker information s is determined using the sampled phonological information h and the aforesaid speech information for learning v according to Formula (5) described above, and the speaker information s~ is sampled based on the probability density function thereof. Further, a conditional probability density function of the speech information for learning v is determined using the sampled phonological information h and the sampled corresponding speaker information s~ according to Formula (3) described above, and the speech information for learning v~ is sampled based on the probability density function thereof (Step S34).

Next, a conditional probability density function of the phonological information h is determined using the corresponding speaker information s~ and speech information for learning v~ sampled in Step S34, and the phonological information h~ is re-sampled based on the probability density function thereof (Step S35).

Further, the log likelihood L shown in Formula (6) described above is partially differentiated with respect to each of the various parameters, and the various parameters are updated by a gradient method (Step S36). To be specific, a stochastic gradient method is used, and the following Formulas (7) to (13) for partially differentiating the log likelihood L with respect to each of the various parameters are used. Here, $\langle\bullet\rangle_{data}$ on the right side of each differential term represents an expected value of the respectively data, and $\langle\bullet\rangle_{model}$ on the right side of each differential term represents an expected value of the model. It is difficult to calculate the expected value of the model since the number of the terms is large; however, it is possible to approximately calculate the expected value of the model by applying a CD (Contrastive Divergence) method and using the speech information for learning v~, the corresponding speaker information s~, and the phonological information h~ sampled above.

[Mathematical Expression 5]

$$\frac{\partial \mathcal{L}}{\partial M} = \left\langle \sum_k A_k^\top \bar{v} h^\top s_k \right\rangle_{data} - \left\langle \sum_k A_k^\top \bar{v} h^\top s_k \right\rangle_{model} \tag{7}$$

$$\frac{\partial \mathcal{L}}{\partial A_k} = \langle \bar{v} h^\top s_k M^\top \rangle_{data} - \langle \bar{v} h^\top s_k M^\top \rangle_{model} \tag{8}$$

$$\frac{\partial \mathcal{L}}{\partial U} = \langle s \bar{v}^\top \rangle_{data} - \langle s \bar{v}^\top \rangle_{model} \tag{9}$$

$$\frac{\partial \mathcal{L}}{\partial V} = \langle h s^\top \rangle_{data} - \langle h s^\top \rangle_{model} \tag{10}$$

$$\frac{\partial \mathcal{L}}{\partial b} = \langle \bar{v} \rangle_{data} - \langle \bar{v} \rangle_{model} \tag{11}$$

$$\frac{\partial \mathcal{L}}{\partial c} = \langle h \rangle_{data} - \langle h \rangle_{model} \tag{12}$$

$$\frac{\partial \mathcal{L}}{\partial \sigma} = \frac{1}{\sigma^3} \circ (\langle v \circ v = 2v \circ (b + U^\top s + A_s M h) \rangle_{data} - \langle v \circ v - 2v \circ (b + U^\top s + A_s M h) \rangle_{model}), \tag{13}$$

After the various parameters have been updated, if a predetermined ending condition is satisfied (YES), the process will proceed to the next step, and if the predetermined ending condition is not satisfied (NO), the process will return to Step S32. Thereafter, each step will be repeated (Step S37). Examples of the predetermined ending condition include a predetermined number of repeating a series of such steps.

Alternatively, the learning processing may also be configured so that, in the case where the various parameters have been determined and thereafter parameters of another person are to be added, only the parameters indicated by a part of the formulas need to be updated. For example, the parameters are updated by newly obtained learning speech by Formulas (8), (9) and (10), among Formulas (7) to (13) indicated in [Mathematical Expression 5]. With respect to the parameter obtained by Formulas (7), (11) and (12), the learned parameters may either be used just as they are (i.e., without being updated), or be updated similar to the other parameters. In the case where only a part of the parameters are updated, the learning speech is added by performing simple arithmetic processing.

Description will be continued below with reference to FIG. 4 again. As parameters determined by learning, the parameter estimating section 114 transfers the parameters estimated by a series of aforesaid steps to the voice converting section 124 of the voice conversion processing unit 12 (Step S4).

Next, as the voice conversion processing, the user operates the input section (not shown) to set target speaker information $s^{(o)}$, wherein the target speaker is the target of the voice conversion in the speaker information setting section 123 of the voice conversion processing unit 12 (Step S5). The speech signal acquisition section 121 acquires the speech signal for conversion (Step S6).

Similar to the case of performing parameter learning processing, the pre-processing section 122 generates the speech information for conversion $v^{(i)}$ based on the speech signal for conversion, and outputs the speech information for conversion $v^{(i)}$ along with the aforesaid target speaker information $s^{(o)}$ (Step S7). Incidentally, the speech signal for conversion $v^{(i)}$ is generated following the same steps as the aforesaid Step S2 (i.e., Steps S21 to S23).

The voice converting section 124 generates converted speech information $V^{(o)}$ from the speech information for conversion $v^{(i)}$ based on the target speaker information $s^{(o)}$ (Step S8).

Figure 7:
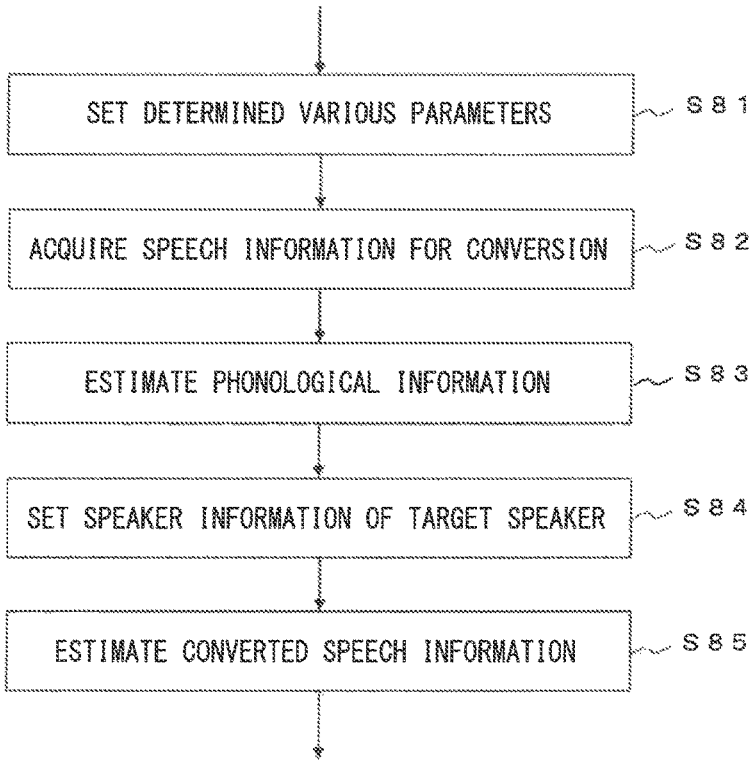
FIG. 7 is a flowchart showing a detailed example of the voice conversion shown in FIG. 4.

The details of Step S8 are shown in FIG. 7. The details of Step S8 will be described below with reference to FIG. 7. First, the various parameters acquired from the parameter estimating section 114 of the parameter learning unit 11 are set in the probabilistic model 3-way RBM (Step S81). Further, the speech information for conversion is acquired from the pre-processing section 122 (Step S82), and the phonological information $\hat{h}$ is estimated by inputting the acquired speech information for conversion to the below Formula (14) (Step S83).

Thereafter, the speaker information $s^{(o)}$ of the target speaker having been learned in the parameter learning processing is set based on the setting in the speaker information setting section 123 (Step S84). Incidentally, in the third line of the below Formula (14), the "h'" and "s'" in the denominator are used so as to be distinguished from the "h" and "s" in the numerator in calculation; and they have the same meaning as the "h" and "s".

[Mathematical Expression 6]

$$\begin{aligned}\hat{h} &\triangleq \mathbb{E}[h \mid v^{(i)}] \\ &= [p(h_j = 1 \mid v^{(i)})] \\ &= \left[\frac{\Sigma_s p(v^{(i)}, h_j = 1, s)}{\Sigma_{h'} \Sigma_{s'} p(v^{(i)}, h', s')}\right] \\ &= f(c + g(V + \bar{v}^{(i)\top} U^\top + M^\top [A_k^\top \bar{v}^{(i)}])),\end{aligned} \tag{14}$$

The calculated phonological information $\hat{h}$ is used to estimate the converted speech information $v^{(o)}$ according to the below Formula (15) (Step S85). The estimated converted speech information $v^{(o)}$ is outputted to the post-processing section 125.

[Mathematical Expression 7]

$$\begin{aligned}\hat{v}^{(o)} &\triangleq \underset{v^{(o)}}{\operatorname{argmax}}\, p(v^{(o)} \mid v^{(i)}, s^{(o)}) \\ &= \underset{v^{(o)}}{\operatorname{argmax}} \sum_h p(h \mid v^{(i)}, s^{(o)}) p(v^{(o)} \mid h, v^{(i)}, s^{(o)}) \\ &\simeq \underset{v^{(o)}}{\operatorname{argmax}}\, p(\hat{h} \mid v^{(i)}, s^{(o)}) p(v^{(o)} \mid \hat{h}, v^{(i)}, s^{(o)}) \\ &= \underset{v^{(o)}}{\operatorname{argmax}}\, p(v^{(o)} \mid \hat{h}, s^{(o)}) \\ &= b + U_{o:}^\top + A_o M \hat{h},\end{aligned} \tag{15}$$

Figure 8:
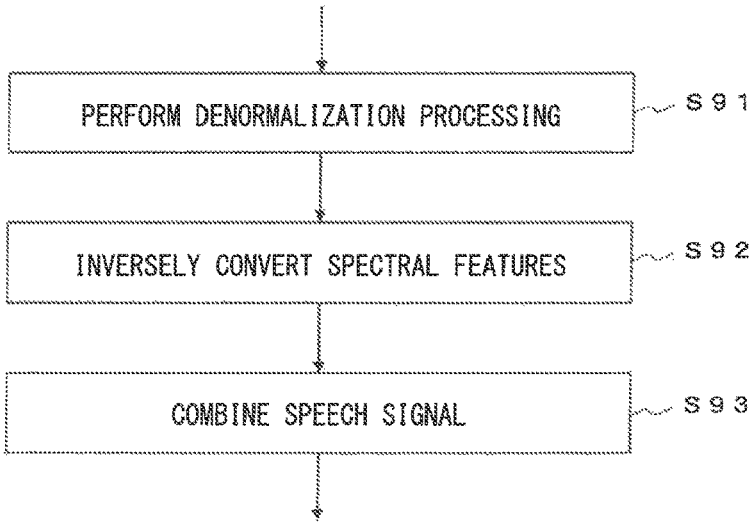
FIG. 8 is a flowchart showing a detailed example of the post-processing shown in FIG. 4.

Back to FIG. 4, the post-processing section 125 uses the converted speech information $v^{(o)}$ to generate the converted speech signal (Step S9). To be specific, as shown in FIG. 8, denormalization processing (i.e., processing for performing the inverse function of the function used for the aforesaid normalization processing) is performed on the normalized converted speech signal $v^{(o)}$ (Step S91), the denormalized spectral features are inversely converted to thereby generate the converted speech signal of each frame (Step S92), and the converted speech signal of each frame is combined to each other in time order to thereby generate the converted speech signal (Step S92).

As shown in FIG. 4, the converted speech signal generated by the post-processing section 125 is outputted to the outside by the speech signal output section 126 (Step S10). The converted speech signal is reproduced by an audio speaker connected to the outside, so that the input speech having been converted into the speech of the target speaker can be heard.

As can be known from the above, according to the present invention, with the probabilistic model 3-way RBM, it is possible to estimate the phonological information based on the speech information only, while considering the speaker information. Therefore, when performing voice conversion, it is possible to perform voice conversion to convert the voice of an input speaker into the voice of a target speaker even if the input speaker is not specified. Also, it is possible to perform voice conversion to convert the voice of an input speaker into the voice of a target speaker even if the speech of the input speaker is a speech not prepared for learning when performing learning processing.

EXPERIMENTAL EXAMPLES

To verify the effects of the present invention, two experiments have been carried out, which are: [1] An experiment for comparing the conversion accuracy of the conventional non-parallel voice conversion with the conversion accuracy of the present invention, and [2] An experiment for comparing the conversion accuracy of the arbitrary source approach with the specific source approach in the present invention.

In the experiments, 58 speakers (including 27 male speakers and 31 female speakers) were randomly selected from a continuous speech database of Acoustical Society of Japan, wherein speech data of 5 pieces of utterance was used for learning, and speech data of 10 pieces of utterance was used for evaluation. 32-dimensional Mel-cepstrum features were used as the spectral features. The dimension number of the phonological information was 16. MDIR (mel-distortion improvement ratio), which is an objective evaluation criterion, was used as an evaluation scale.

The following Formula (16) expresses the MDIR used in the experiments, in which the larger the value of Formula (16) is, the higher the accuracy becomes. Models were learned using a stochastic gradient method in which the learning rate was 0.01, the moment coefficient was 0.9, the batch size was 100, and the repeat count was 50.

[Mathematical Expression 8]

$$MDIR[\text{dB}] = \frac{10\sqrt{2}}{\ln 10}\left(\| v^{(o)} - v^{(i)} \|^2 - \| v^{(o)} - \hat{v}^{(o)} \|^2\right) \tag{16}$$

TABLE 1

| Method | ARBM | SATBM | Proposed |
|---|---|---|---|
| MDIR [dB] | 2.11 | 2.66 | 3.07 |

TABLE 2

| | MDIR [dB] |
|---|---|
| Correct speaker specified | 3.07 |
| Different speaker specified | 2.79 |
| Arbitrary source approach | 3.03 |

[Experimental Results]

First, the voice conversion performed by the 3-way RBM of the present invention is compared with ARBM (Adaptive Restricted Boltzmann Machine) and SATBM (Speaker Adaptive Trainable Boltzmann Machine), which both are conventional methods based on non-parallel voice conversion. As can be known from the above [Table 1], the highest accuracy can be obtained by the method according to the present invention.

Next, the conversion accuracies of both the arbitrary source approach and the specific source approach in the 3-way RBM of the present invention were compared with each other. The experimental results are shown in the above [Table 2]. With the method based on the arbitrary source approach of the present invention, although the input speaker was not specified, a result not inferior to that of the case where the correct speaker was specified could be obtained. Incidentally, it is confirmed that the accuracy will go down if a different speaker is specified.

<Modifications>

In the aforesaid embodiment, the description is made based on an example in which, as the input speech for performing learning (i.e., the speech of the input speaker), a speech of speaking voice of human is processed; however, the present invention also include a configuration in which, as the speech signal for learning (i.e., the input signal), a speech signal of various sounds other than the speaking voice of human may be learned, as long as learning for obtaining various kinds of information described in the aforesaid embodiment can be performed. For example, any kinds of sounds, such as siren wailing, animal call and the like, may be learned.

REFERENCE SIGNS LIST

1 voice conversion device
11 parameter learning unit
12 voice conversion processing unit
101 CPU
102 ROM
103 RAM
104 HDD/SDD
105 connection I/F
106 communication I/F
111, 121 speech signal acquisition section
112, 122 pre-processing section
113 corresponding speaker information acquisition section
114 parameter estimating section
1141 speech information estimating section
1142 speaker information estimating section
1143 phonological information estimating section
123 speaker information setting section
1241 speech information setting section
1242 speaker information setting section
1243 phonological information setting section
125 post-processing section
126 speech signal output section

The invention claimed is:

1. A voice conversion device adapted to perform voice conversion to convert the voice of an input speaker into the voice of a target speaker, comprising:

a central processing unit (CPU);

a parameter learning unit, executed by the CPU, in which a probabilistic model that uses speech information, speaker information, and phonological information as variables to thereby express relationships among binding energies between any two of the speech information, the speaker information and the phonological information by parameters is prepared, wherein the speech information is obtained based on a speech, the speaker information corresponds to the speech information, and the phonological information expresses the phoneme of the speech, and in which the parameters are determined by performing learning by sequentially inputting the speech information and the speaker information corresponding to the speech information into the probabilistic model; and a voice conversion processing unit, executed by the CPU, that performs voice conversion processing of the speech information obtained on the basis of the speech of the input speaker, based both on the parameters determined by the parameter learning unit and on the speaker information of the target speaker.

2. The voice conversion device according to claim 1, wherein the parameters are composed of seven parameters which are M, V, U, A, b, c and σ, wherein M expresses the degree of the relationship between the speech information and the phonological information, V expresses the degree of the relationship between the phonological information and the speaker information, U expresses the degree of the relationship between the speaker information and the speech information, A represents a set of projection matrix determined by the speaker information, b represents a bias of the speech information, c represents a bias of the speech information, and σ represents the deviation of the speech information, and wherein the seven parameters are related to each other by the following Formulas (A) to (D) where v represents the speech information, h represents the phonological information, and s represents the speaker information.

$$E(v, h, s) = \frac{1}{2}v^\top \bar{v} - b^\top \bar{v} - c^\top h - h^\top Vs - s^\top U\bar{v} - \bar{v}^\top A_s Mh, \quad \text{(A)}$$

$$p(v \mid h, s) = \mathcal{N}(v \mid b + U^\top s + A_s Mh, \sigma^2) \quad \text{(B)}$$

$$p(h \mid s, v) = \mathcal{B}(h \mid f(c + Vs + M^\top A_s^\top \bar{v})) \quad \text{(C)}$$

$$p(s \mid v, h) = \mathcal{B}(s \mid f(U\bar{v} + V^\top h + [\bar{v}^\top A_k]Mh)). \quad \text{(D)}$$

3. A voice conversion method for performing voice conversion to convert the voice of an input speaker to the voice of a target speaker, comprising:

a parameter learning step in which a probabilistic model that uses speech information, speaker information, and phonological information as variables to thereby express relationships among binding energies between any two of the speech information, the speaker information and the phonological information by parameters is prepared, wherein the speech information is obtained based on a speech, the speaker information corresponds to the speech information, and the phonological information expresses the phoneme of the speech, and in which the parameters are determined by performing learning by sequentially inputting the speech information and the speaker information corresponding to the speech information into the probabilistic model; and a voice conversion processing step of performing voice conversion processing of the speech information obtained on the basis of the speech of the input speaker, based both on the parameters determined in the parameter learning step and on the speaker information of the target speaker.

4. A non-transitory computer readable medium embodying a program that, when executed by a central processing unit (CPU), causes a computer to execute a method, the method comprising:

a parameter learning step in which a probabilistic model that uses speech information, speaker information, and phonological information as variables to thereby express relationships among binding energies between any two of the speech information, the speaker information and the phonological information by parameters is prepared, wherein the speech information is obtained based on a speech, the speaker information corresponds to the speech information, and the phonological information expresses the phoneme of the speech, and in which the parameters are determined by performing learning by sequentially inputting the speech information and the speaker information corresponding to the speech information into the probabilistic model; and a voice conversion processing step of performing voice conversion processing of the speech information obtained on the basis of the speech of the input speaker, based both on the parameters determined in the parameter learning step and on the speaker information of a target speaker.

* * * * *